US006287109B1

(12) United States Patent
Hirota

(10) Patent No.: US 6,287,109 B1
(45) Date of Patent: Sep. 11, 2001

(54) CHILD-PROOF LOCKING MECHANISM FOR LIGHTER

(75) Inventor: Ryohei Hirota, Tokyo (JP)

(73) Assignee: Hirota & Co., Ltd., Tokyo (JP)

( * ) Notice: Subject to any disclaimer, the term of this patent is extended or adjusted under 35 U.S.C. 154(b) by 0 days.

(21) Appl. No.: 09/650,859

(22) Filed: Aug. 29, 2000

(51) Int. Cl.[7] ..... F23D 11/36
(52) U.S. Cl. ..... 431/153; 431/255
(58) Field of Search ..... 431/153, 277, 431/253, 344, 255, 254

(56) References Cited

U.S. PATENT DOCUMENTS 5,145,358 * 9/1992 Shike et al. ..... 431/153
5,462,432 * 10/1995 Kim ..... 431/153
5,829,963 * 11/1998 Ichikawa ..... 431/255
5,839,892 * 11/1998 Hwang ..... 431/153

* cited by examiner

*Primary Examiner*—James C. Yeung
(74) *Attorney, Agent, or Firm*—Arent Fox Kintner Plotkin & Kahn

(57) ABSTRACT

Disclosed is a locking mechanism for use in a piezoelectric lighter. The locking mechanism includes a slider piece and an inverted "L"-shaped latch member. The slider piece is slidably attached to the top of the flame-producing unit of the lighter, and is coplanar with the lighter body. The slider piece is spring-biased normally to its rear locking position in which its lock spacer stays above a slot made at the horizontal-to-vertical transition of the latch member. Depression of the slider piece allows the lock spacer to fall in the slot, so that the flame-producing unit may reach short of the ignition point at which the piezoelectric element can be struck for ignition. The vertical descent extension of the latch member cannot raise an actuator lever to open the gas valve, either. Thus, no ignition can be caused. When the slider piece is moved forward to put the lock spacer on an abutment which rises upright from the horizontal-to-vertical transition of the latch member, depression of the slider piece allows the flame-producing unit to strike the piezoelectric unit, and at the same time, the vertical descent extension of the latch member to raise the actuator lever to open the gas valve. Thus, a flame can be produced.

7 Claims, 12 Drawing Sheets

CHILD-PROOF LOCKING MECHANISM FOR LIGHTER

BACKGROUND OF THE INVENTION

1. Field of the Invention

The present invention relates to a locking mechanism for a lighter, particularly a piezoelectric lighter, which locking mechanism assures that children are prevented from producing a flame while playing with the lighter.

2. Related Arts

A gas lighter is responsive to depression of its flame-producing unit for allowing the gas fuel nozzle to eject the combustible gas, and at the same time allowing the sparking unit to produce spark, thereby producing a flame.

One example of sparking unit uses a flint for making small flashes of flame when rubbed with an associated file. Another example of sparking unit uses a piezoelectric device which can generate a voltage high enough to cause electric sparks to appear between opposite electrodes for ignition when struck with a striker (hereinafter referred to as "piezoelectric lighter").

The piezoelectric lighter is responsive to depression of its flame-producing unit for allowing the gas fuel nozzle to eject the combustible gas, and at the same time allowing the sparking unit to produce electric sparks for ignition. Thus, a flame can be produced very quickly. There is, therefore, a fear of causing a fire to break out or a child to get burnt in the hand if the child is allowed to play with the piezoelectric lighter. In the hope of preventing such an accident the piezoelectric lighter is equipped with lock means for preventing the producing of undesired flame.

Lock means for use in a flint type of gas lighters is disclosed in Japanese Utility Model 54-44176(A). This lock means is designed for use in a gas lighter whose flame-producing unit is responsive to depression for opening an associated gas nozzle to eject the combustible gas for ignition. Specifically the lock means comprises a spring-biased rotary lever rotatable about its pivot axle under the flame-producing unit. The rotary lever can be rotated with thumb to its locking position in which it is caught by the upper edge of the lighter body to prevent the overlying flame-producing unit from descending. Also, the rotary lever can be rotated to its unlocking position in which it is made free from the upper edge to stay above a slot, which is made in the upper edge of the lighter body. The overlying flame-producing unit is depressed, and accordingly the rotary lever is lowered in the slot, thus allowing the flame-producing unit to open the gas nozzle for ignition.

The rotary lever partly projects from the lighter body, and therefore, if the rotary lever should be caught by fingers or something like that in one's pocket or bag, it is possible that the gas lighter be unlocked.

The rotary lever is spring-biased and raised toward the overlying thumb-push button of the flame-producing unit, so that it may be responsive to a gentle push for turning toward its unlocking position, and is apt to turn more than required (180 or more degree-wide angular distance).

The rotary lever is partly exposed, and the associated slot is visible at the upper edge of the lighter body. The gas lighter, therefore, is less pleasing in appearance. This is disadvantageous to merchandising.

SUMMARY OF THE INVENTION

In view of the above, one object of the present invention is to provide a child-proof locking mechanism for lighters, which mechanism facilitates the locking of the lighter, still assuring that undesired unlocking be prevented.

To attain this object a locking mechanism for a lighter comprising, in its body, a flame-producing unit which can be depressed by thumb, a piezoelectric unit responsive to depression of the flame-producing unit for generating a high-voltage between an associated electrode and the nozzle of a fuel valve, a valve lever responsive to depression of the flame-producing unit for opening the fuel valve, and lock means for preventing the flame-producing unit from being operated, is improved according to the present invention in that said lock means comprises a slider piece slidably attached to the top of said flame-producing unit, said slider piece having a lock spacer integrally connected to its lower surface, and a latch member responsive to said slider piece put in one position for preventing the opening of said fuel valve and/or the striking of the piezoelectric unit, and responsive to said slider put in the other position for permitting the opening of said fuel valve and/or the striking of the piezoelectric unit.

The latch member may comprise a support-and-guide for supporting the slider piece above the top of the piezoelectric unit, and an abutment spaced apart from but integrally connected to the support-and-guide for abutting on the bottom of said lock spacer only when said slider piece is put in one position, said abutment being spaced apart from the support-and-guide to define a slot wide and deep enough to allow said lock spacer to fall down in the slot.

The slot may be deep enough to make useless the push stroke required for striking said piezoelectric unit.

The enclosure of the body may have a shelf-like projection formed on its inner wall in the vicinity of said piezoelectric unit to limit the push stroke required for striking said piezoelectric unit.

The slider piece may be spring-biased upward so as to be coplanar with the top of said flame-producing unit, allowing said lock spacer to stay above the slot. The upward resilient force has a rearward component to drive and retain the slider piece in its locking position. When it is desired that a flame is produced, the slider piece is pushed forward with thumb against the rearward component of resilient force. Removal of thumb from the slider piece allows the flame to be extinguished, and at the same time, the slider piece returns automatically to its initial locking position, thus assuring that the lighter is prevented from remaining in unlocking condition.

The latch member may comprise a support-and-guide for holding and supporting the slider piece above the top of the piezoelectric unit, and a guide extension descending downward from the inner side of the support-and-guide, the descendent guide extension being urged by an associated resilient member, thereby putting the slider piece in the one position, and at the same time, pushing and inclining the piezoelectric unit to allow its outer casing to be caught by the descending bottom end of the flame-producing unit.

The resilient member may be a leaf spring formed on the skirt of said flame-producing unit by cutting parallel slots therein. Advantageously this requires no extra separate spring.

Other objects and advantages of the present invention will be understood from the following description of child-proof locking mechanisms for gas lighters according to preferred embodiments of the present invention, which are shown in accompanying drawings.

DETAILED DESCRIPTION OF PREFERRED EMBODIMENT

Figure 1:
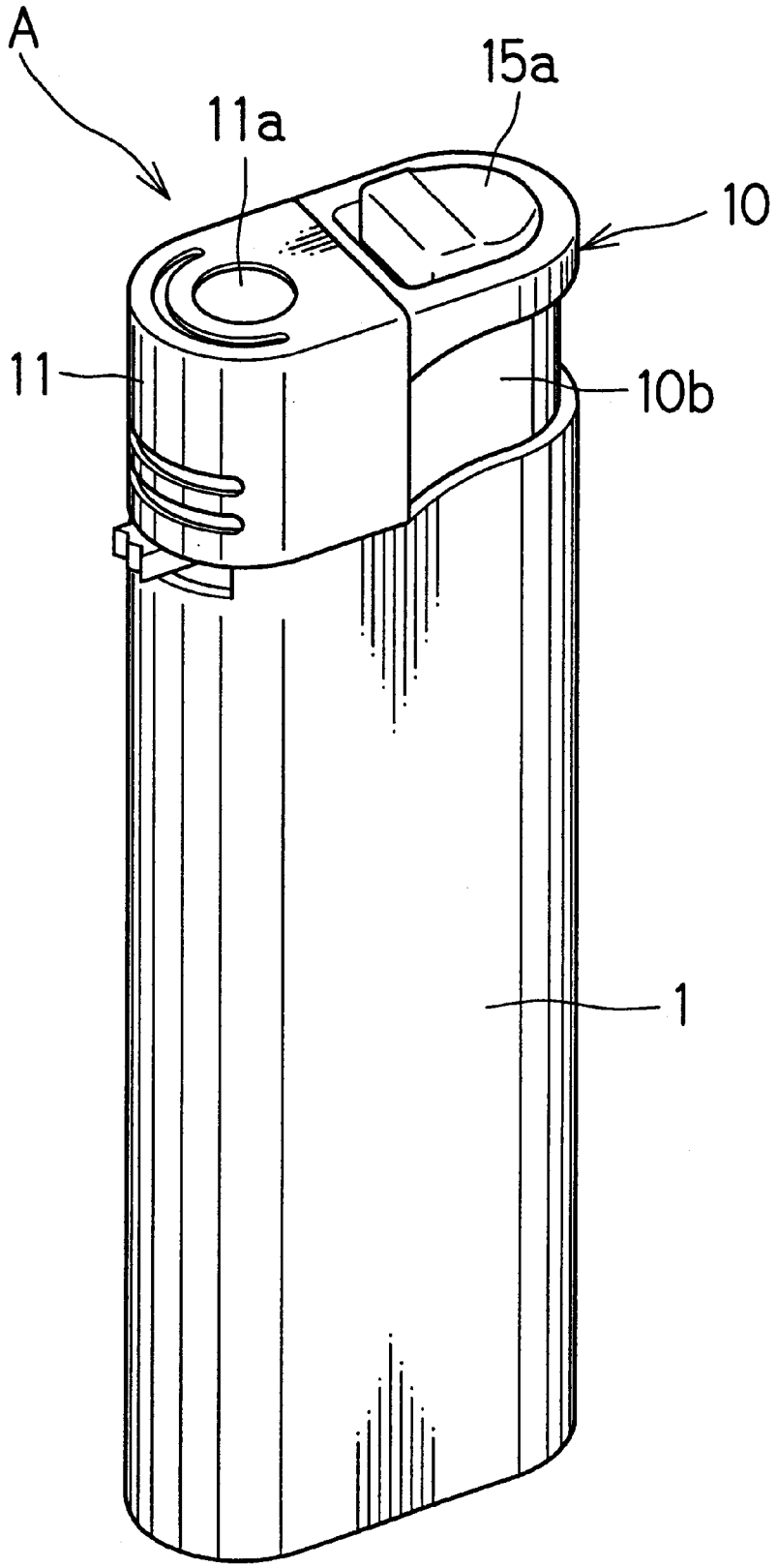
FIG. 1 is a perspective view of a piezoelectric lighter equipped with a locking mechanism according to a first embodiment of the present invention.
Figure 2:
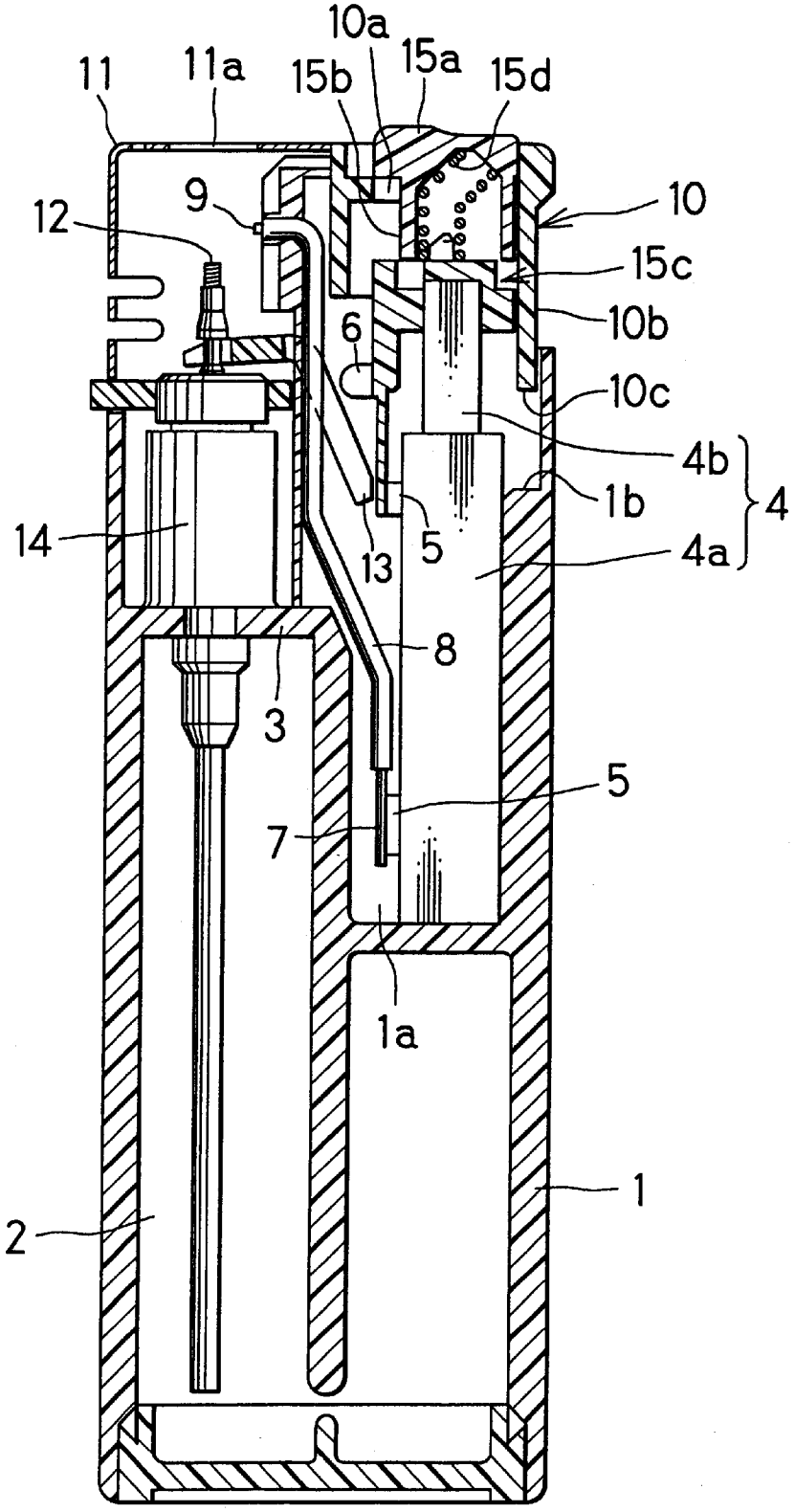
FIG. 2 is a longitudinal section of the piezoelectric lighter of FIG. 1, illustrating the piezoelectric lighter in its locking position.

Referring to FIGS. 1 to 6, a piezoelectric lighter "A" which is equipped with a locking mechanism according to the first embodiment comprises, in its body 1, a liquefied gas storage 2 having a top cover plate 3 hermetically closing the outlet of the liquefied gas storage 2, a fuel valve 14 communicating with the outlet of the liquefied gas storage 2, an intermediate casing (not shown) supporting a piezoelectric unit 4, and a flame-producing unit 10 operatively connected both to the nozzle of the fuel valve 14 and to the piezoelectric unit 4. The flame-producing unit 10 can be depressed by thumb, and the piezoelectric unit 4 is responsive to depression of the flame-producing unit 10 for generating a high-voltage between an associated electrode 9 and the nozzle 12 of the fuel valve 4. A valve lever 13 is responsive to depression of the flame-producing unit 10 for opening the fuel valve 14.

The lighter body 1 is made of a PET resin and such like, and it has a shelf-like projection 1*b* formed on its inner wall to define the stroke of the flame-producing unit 10 for ignition.

The piezoelectric unit 4 comprises outer and inner telescoping casings 4*a* and 4*b*, a piezoelectric element and a striking mechanism. The piezoelectric element and the striking mechanism are installed in the inner casing 4*b*. The striking mechanism comprises a hammer, a spring for biasing the hammer toward its initial position and etc. Depression of the inner casing 4*b* into the outer casing 4*a* will allow the hammer to strike the piezoelectric element, thereby causing a high voltage to appear between the opposite terminals 5 and 6 of the piezoelectric unit 4.

A conductor 7 extends from the terminal 5 of the piezoelectric unit 4 into a connection pipe 8, which ends with an electric discharging terminal 9.

The piezoelectric unit 4 is contained in the intermediate casing (not shown) with the upper end of the inner casing 4*b* projecting from the intermediate casing, and the flame-producing unit 10 is put on the top end of the inner casing 4*b*. The flame-producing unit 10 is spring-biased toward its upper position to be coplanar with the top of the lighter body. The flame-producing unit 10 is so installed in the lighter body that it may be prevented from slipping off from the lighter body, as described later in detail.

The electric discharging terminal 9 is positioned close to the nozzle 12 of the fuel valve 14, and a wind-shield 11 encircles the electric discharging terminal 9.

The wind-shield 11 is a metal mold, which has nails cut out and formed on its side. The wind-shield 11 is fixed in place with its nails caught by the counter recesses, which are made on the intermediate casing.

The fuel valve 14 has its nozzle 12 directed toward the flame aperture 11*a* of the wind-shield 11. The nozzle 12 can be raised by an associated valve-actuating lever 13 to allow the valve 14 to open and eject the combustible gas.

The valve-actuating lever 13 is made of an electrically conductive material, and it is responsive to depression of the flame-producing unit 10 for rising to the valve-opening position, and then the electric discharge appears between the nozzle 12 and the electric discharging terminal 9 for ignition.

Figure 3:
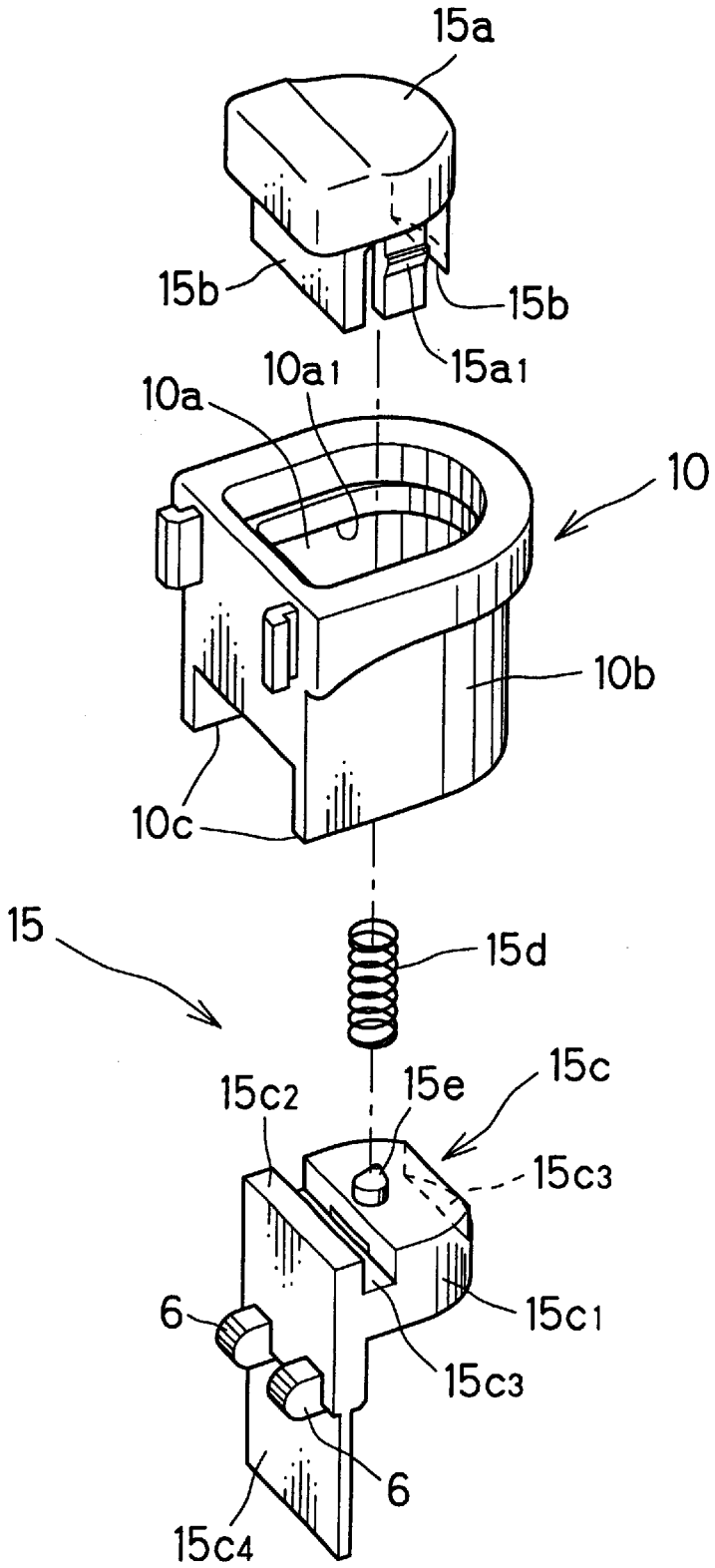
FIG. 3 is an exploded view of the major parts of the locking mechanism.
Figure 4:
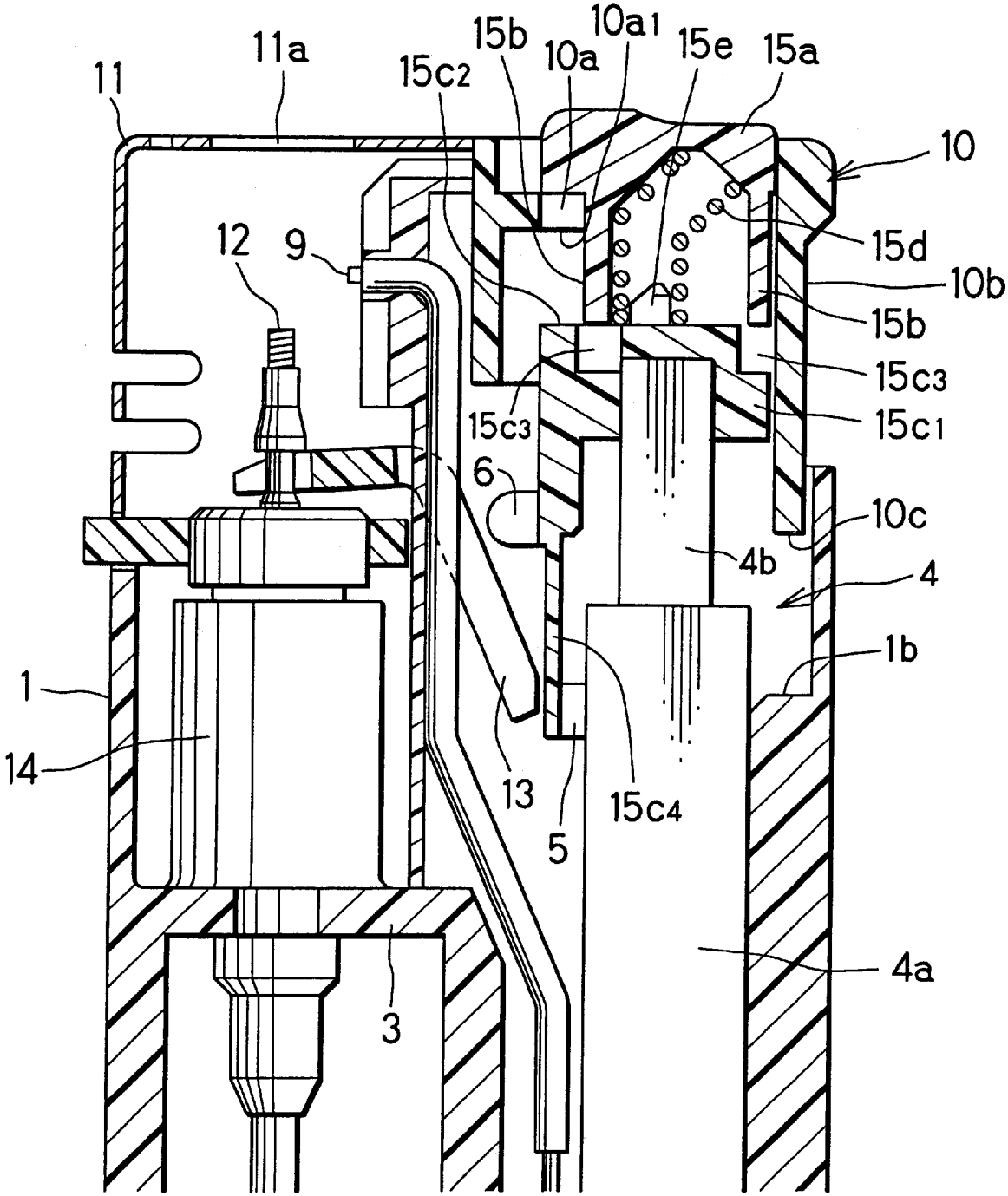
FIG. 4 is an enlarged longitudinal section of a top fragment of the piezoelectric lighter, illustrating the locking mechanism in its locking position.
Figure 5:
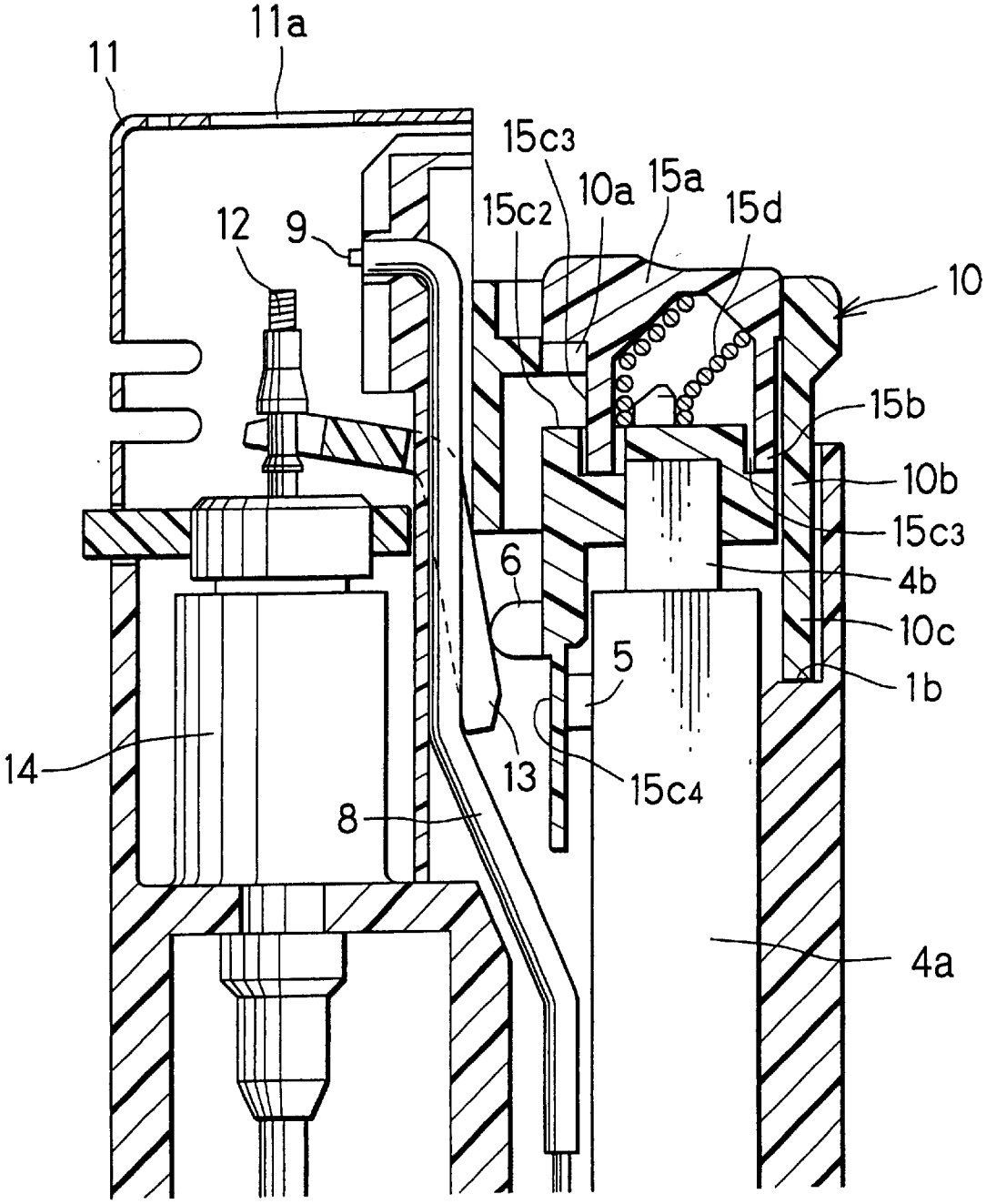
FIG. 5 is a similar enlarged longitudinal section, but illustrating the locking mechanism in its ignition-preventive position.

The flame-producing unit 10 is operatively connected to a locking mechanism 15 for preventing its depression. Referring to FIGS. 3 and 4, the locking mechanism 15 comprises a slider piece 15*a* and a latch member 15*c*. The slider piece 15*a* has a lock spacer 15*b* and two nails $\mathbf{15}a_1$ integrally connected to its lower surface. The inverted "L"-shaped latch member 15*c* has a horizontal support-and-guide $\mathbf{15}c_1$, a vertical abutment-and-guide extension $\mathbf{15}c_2$ and $\mathbf{15}c_4$, and a slot $\mathbf{15}c_3$ made at its horizontal-to-vertical transition for accommodating the lock spacer 15*b* of the slider piece 15*a*. The vertical abutment-and-lock extension has two terminal projections 6 formed on its surface. The slider piece 15*a* is so attached to the top of the flame-producing unit 10 that it may be slidably moved, but may be prevented from slipping off from the flame-producing unit 10. When the slider piece 15*a* is moved to one position (locking position), the latch member 15*c* prevents the opening of the fuel valve 14 and the striking of the piezoelectric unit 4. When the slider piece 15*a* is moved to the other position (unlocking position), the latch member 15*c* permits the opening of the fuel valve 14 and the striking of the piezoelectric unit 4.

The slider piece 15*a* is slidably fitted in the top opening 10*a* of the flame-producing unit 10. As seen from FIGS. 3 and 4, the slider piece 15*a* has a concave surface formed on its top, thus permitting the thumb to be closely fitted on its top surface, which is coplanar with the top of the flame-producing unit 10. As seen from FIG. 3, the slider piece 15*a* has its resilient nails $\mathbf{15}a_1$, cut out and formed on its opposite sides, and the slider piece 15*a* is press-fitted in the top opening 10*a* of the flame-producing unit 10 with its resilient nails $\mathbf{15}a_1$ caught by the inner projection $\mathbf{10}a_1$ formed on the inner wall of the flame-producing unit 10, thus permitting the slider piece 15*a* to move back and forth, but preventing it from slipping off from the flame-producing unit 10. The slider 15*a* is pushed upward to its locking position by an associated coiled spring 15*d*, which is fitted on a stud 15*e* to be positioned between the slider piece 15*a* and the horizontal guide-and-support $\mathbf{15}c_1$, of the inverted "L"-shaped latch member 15*c*.

The coiled spring 15*d* is compressed so that it may be yieldingly bent rearward to conform the inner hollow shape of the slider piece 15*a*, thereby pushing the slider piece 15*a* rearward (apart from the wind shield 11) all the time (see FIG. 4).

The slider piece 15*a* is moved forward to the unlatching position against the counter resilient force from the coiled spring 15*d* so that the lock spacer 15*b* of the slider piece 15*a* may be put above the abutment 15$c_2$. In this position the terminal projections 6 are allowed to actuate the rotary lever 13 for opening the fuel valve 14, and at the same time, the striking of the piezoelectric element is permitted for ignition. After ignition the slider piece 15*a* is released by removing the thumb from the slider piece 15*a*, allowing the coiled spring 15*d* to drive the slider piece 15*a* to its initial position.

The inverted "L"-shaped latch member 15*c* is made of an electrically conductive material. As described above, its horizontal section is composed of the support-and-guide 15$c_1$, the abutment 15$c_2$, the slot 15$c_3$, and the descendent guide extension 15$c_4$, which extends parallel to one side of the piezoelectric unit 4.

The slot 15$c_3$ is deep enough to make useless the push stroke required for striking the piezoelectric unit 4. The push stroke for the flame-producing unit 10 is determined by the shelf-like projection 1*b* of the inner wall of the lighter housing.

With the arrangement as described above the locking mechanism keeps the slider piece 15*a* normally in locking-permissible position, in which the lock spacer 15*b* stays above the slot 15$c_3$ as seen from FIG. 4. In this position depression of the ignition piece 15 allows the lock spacer 15*b* to fall in the slot 15$c_3$, thereby apparently elongating the distance for the flame-producing unit 10 to follow for ignition, thus reaching short of the striking point.

When the flame-producing unit 10 is depressed, the end 10*c* of the dependent skirt 10*b* of the flame-producing unit 10 abuts on the shelf-like projection 1*b* to prevent further depression, and then the terminal projections 6 of the descendent guide plate 15$c_4$ drives the valve actuating lever 13 too short lateral distance to allow it to open the valve 14, thus causing no ejection of combustible gas from the nozzle 12.

Figure 6:
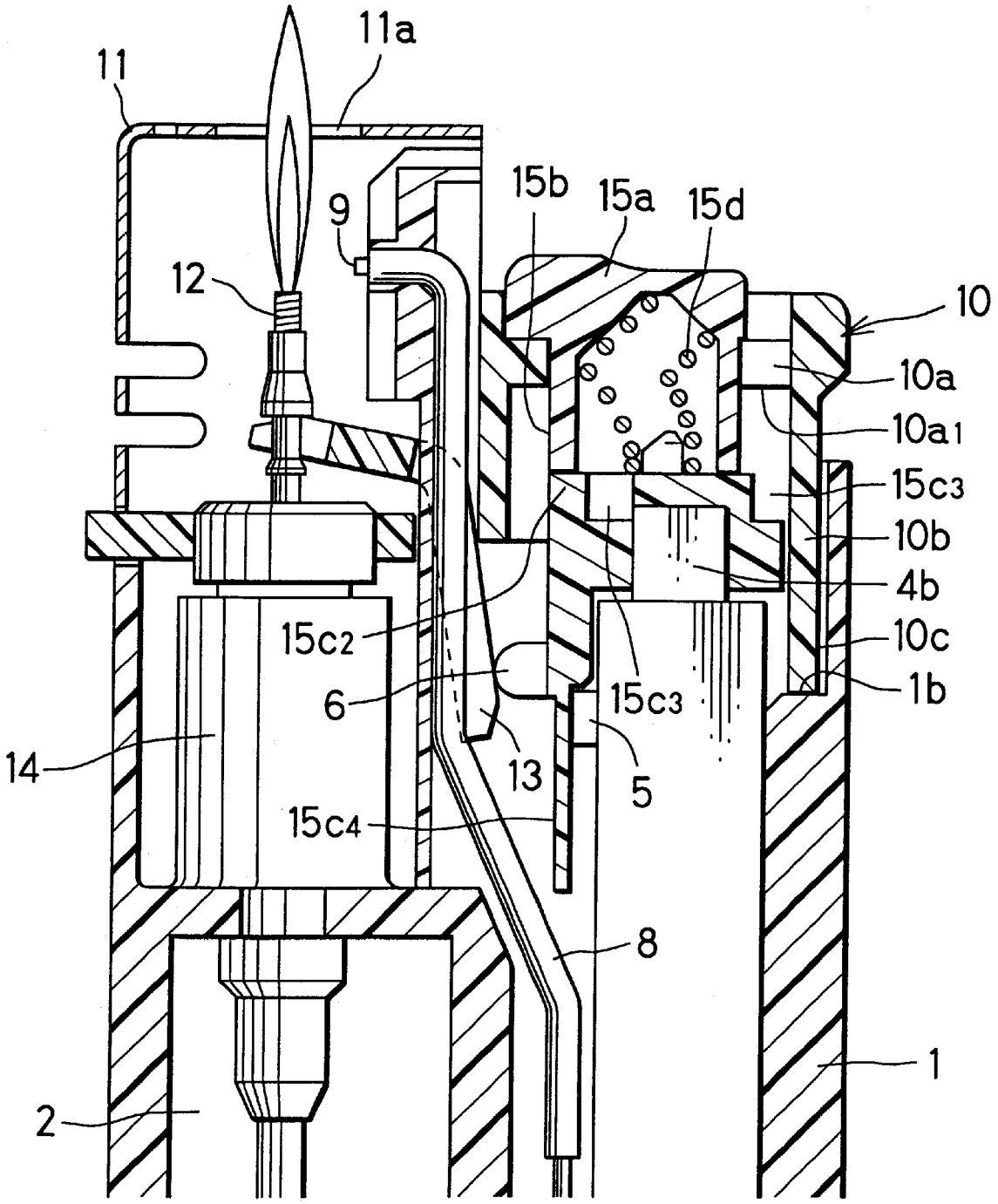
FIG. 6 is a similar enlarged longitudinal section, illustrating the locking mechanism in its ignition-permissible position.
Figure 7:
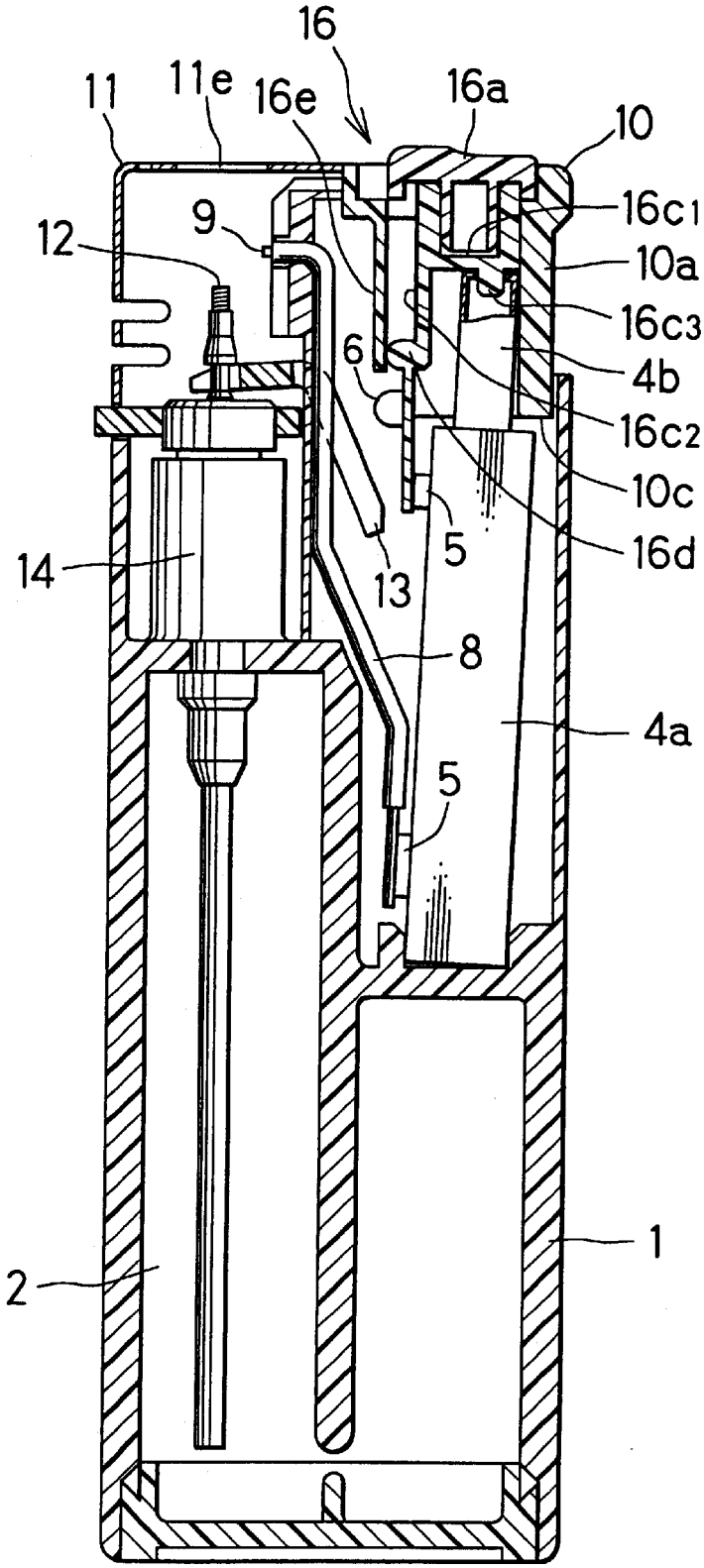
FIG. 7 is a longitudinal section of a piezoelectric lighter according to a second embodiment of the present invention.

Referring to FIG. 6, when it is desired that a flame is produced, the slider piece 15*a* is moved forward to displace the lock spacer 15*b* to above the abutment 15$c_2$ and then, the flame-producing unit 10 is depressed to push down the inner casing 4*b* of the piezoelectric unit 4, and at the same time, the terminal projections 6 push the valve actuating lever 13 laterally until the combustible gas is ejected from the gas nozzle 12. At the same time, the inner casing 4*b* is completely pushed into the outer casing 4*a* of the piezoelectric unit 4, thus allowing the striking mechanism to work on the piezoelectric element. Then, a high voltage appears between the discharging electrode 9 and the gas nozzle 12 to cause electric sparks to appear in the space in which the combustible gas is ejected. Thus, a flame is produced.

After the flame is produced, the thumb is removed from the flame-producing unit 10, thereby allowing the slider piece 15*a* to return to its locking-permissible position, in which the striking mechanism for the piezoelectric unit 4 is put in its rest position, also (see FIG. 4).

The locking mechanism has every part installed in the lighter body except for the slider piece 15*a*, which appears alone on the top of the lighter body, but is almost unnoticeable to children, not causing the gas lighter to become less pleasing in appearance.

The slider piece 15*a* is coplanar with the top surface of the flame-producing unit 10, and therefore, there is no projection to be caught and moved toward ignition inadvertently by fingers in pocket. Even though the flame-producing unit is depressed inadvertently, the striking mechanism for the piezoelectric unit 4 is prevented from working, thus assuring the safety.

FIGS. 7 to 11 show a piezoelectric lighter according to the second embodiment of the present invention, and in these drawings the same parts as in the first embodiment are indicated by same reference numerals, omitting their description, and only the parts which are not found in the first embodiment are indicated by new reference numerals, and are described below.

The locking mechanism 16 comprises an attachment support-and-guide 16*c* for supporting a slider piece 16*a* on the top of the piezoelectric unit, having a lock spacer 16*d* projecting from one side of the attachment support-and-guide 16*c*, and a leaf spring 16*e* abutting on the lock spacer 16*d* to drive and put the slider piece 16*a* in one position or locking-permissible position.

Figure 8:
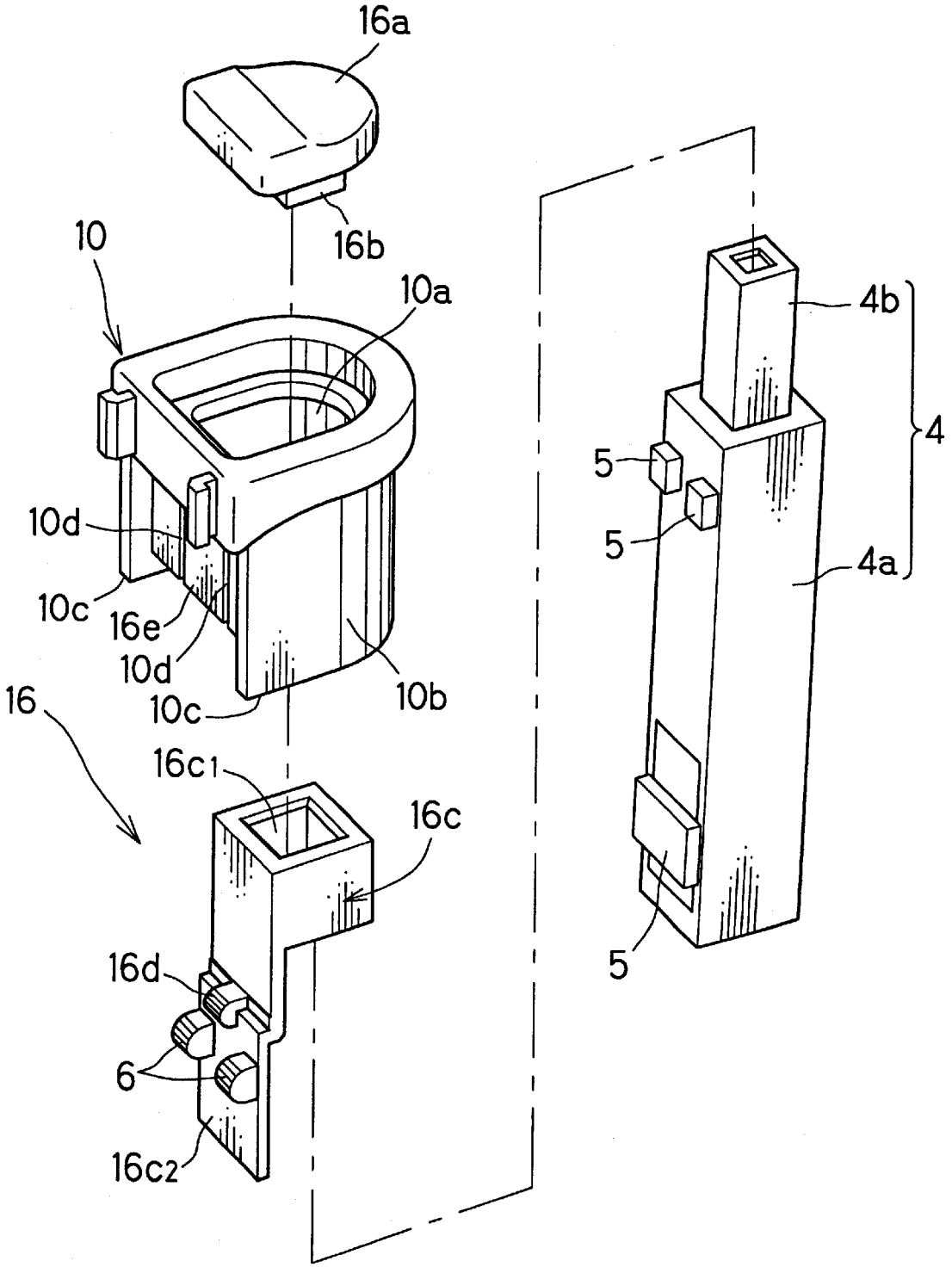
FIG. 8 is an exploded view of the major parts of the locking mechanism.
Figure 9:
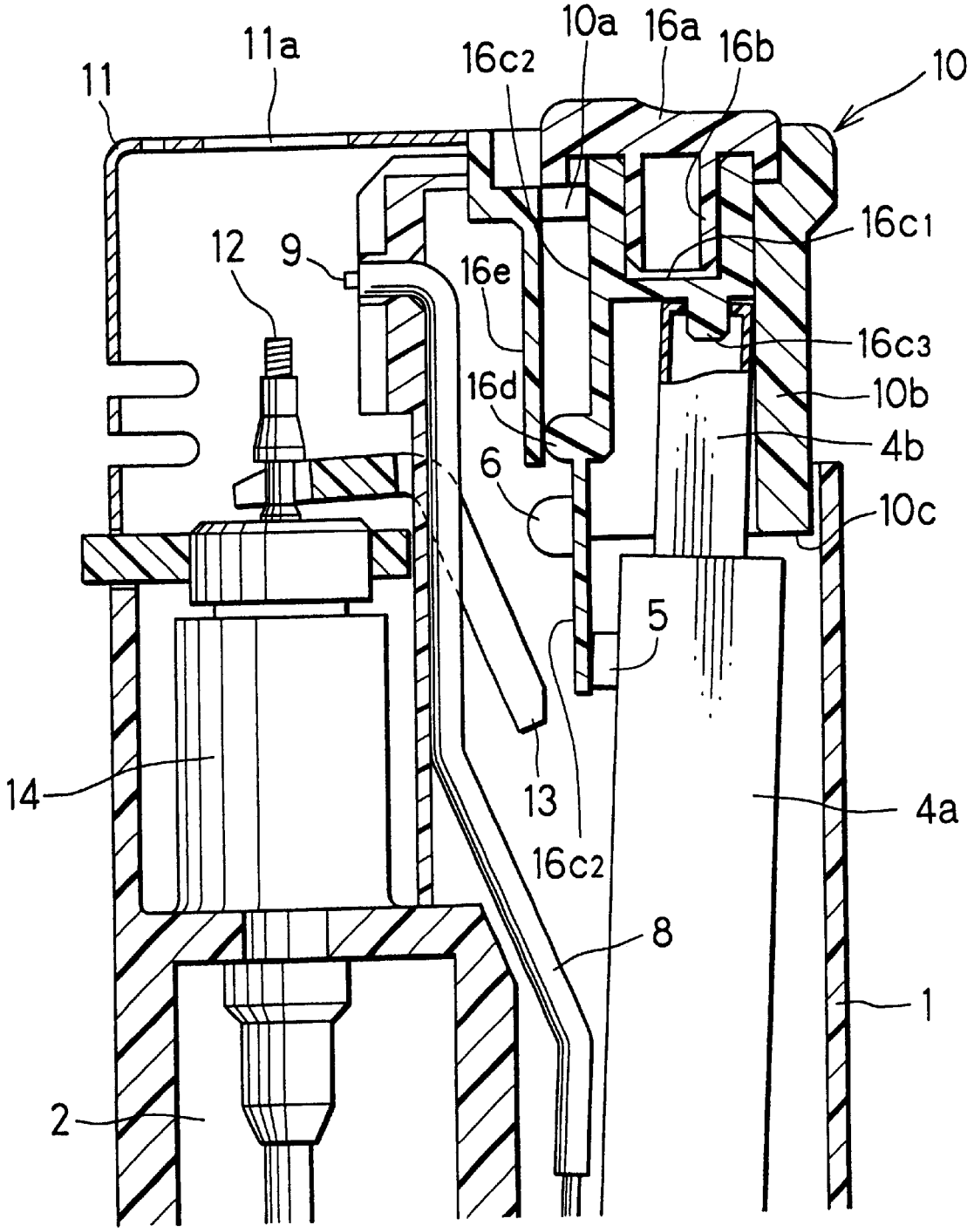
FIG. 9 is an enlarged longitudinal section of a top fragment of the piezoelectric lighter, illustrating the locking mechanism in its locking position.

The attachment support-and-guide 16*c* is made of an electrically conductive material. As shown in FIGS. 8 and 9, the attachment support-and-guide 16*c* comprises a rectangular box-like piece 16$c_1$, for accommodating the flange projection 16*b* of the slider piece 16*a*, a descendent guide extension 16$c_2$ extending from one side of the rectangular box-like piece in parallel to the piezoelectric unit 4, and an abutment projection 16$c_3$ formed on the bottom of the box-like piece to abut on the inner casing 4*b* of the piezoelectric unit 4 (see FIG. 9).

The lock spacer 16*d* projects outward from the intermediate step-wise transition of the guide extension 16$c_2$ to contact the leaf plate 16*e*, and as a counter action the attachment support-and-guide 16*c* and the slider piece 16*a* are driven rightward to incline the piezoelectric unit 4 (see FIG. 9).

As seen from FIG. 8, the leaf spring 16*e* is cut out and formed on the skirt 10*b* by making longitudinal parallel slots 10*d* and 10*d*.

Referring to FIG. 9, the piezoelectric unit 4 is so inclined that the top end of the inner casing 4*b* may be applied obliquely to the movable bottom 10*c* of the flame-producing unit 10, and that the top edge of the outer casing 4*a* may be put close to the skirt of the flame-producing unit 10, thereby preventing depression of the flame-producing unit 10 (locking position).

Figure 10:
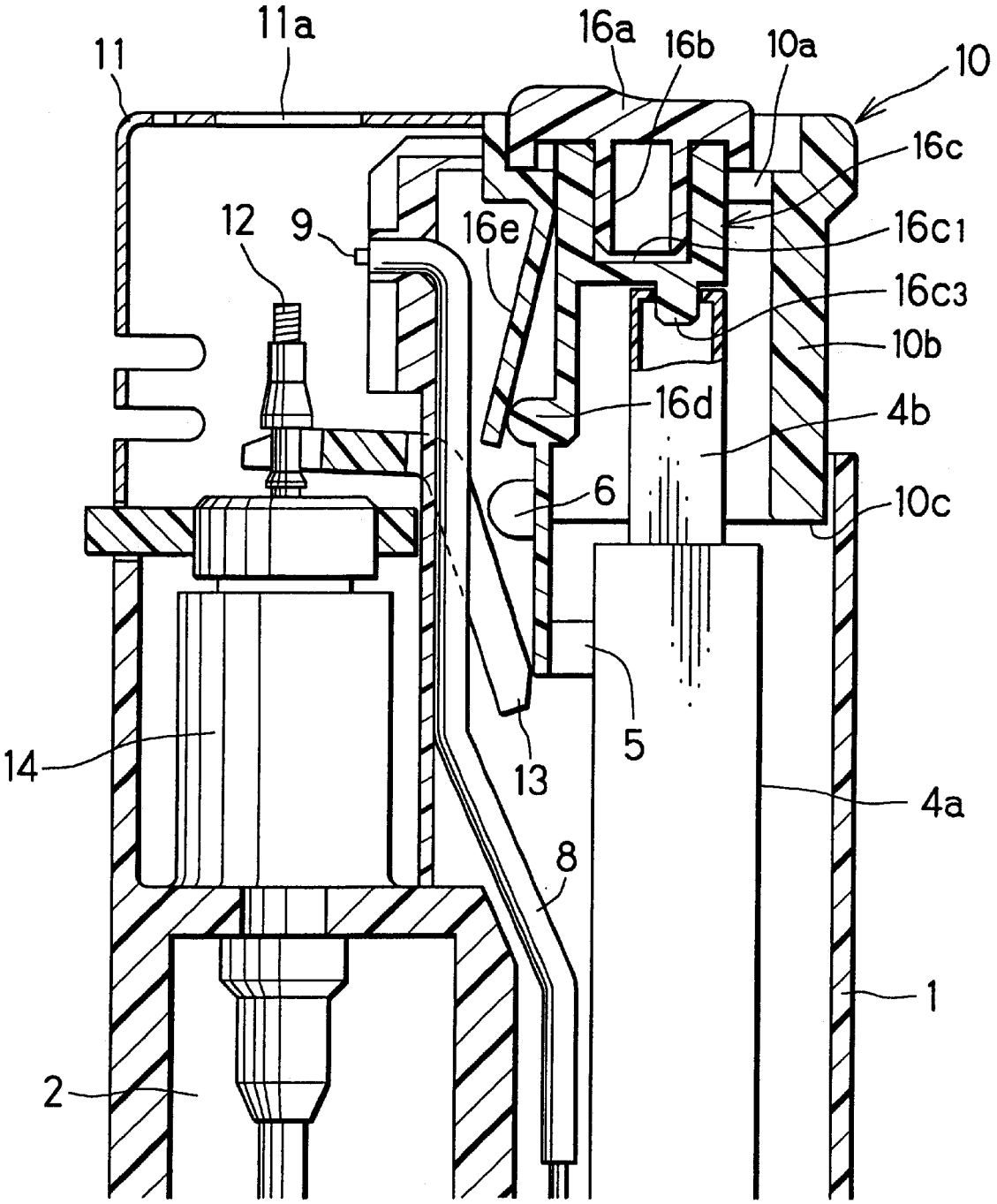
FIG. 10 is a similar enlarged longitudinal section, but illustrating the locking mechanism in its ignition-permissible position.
Figure 11:
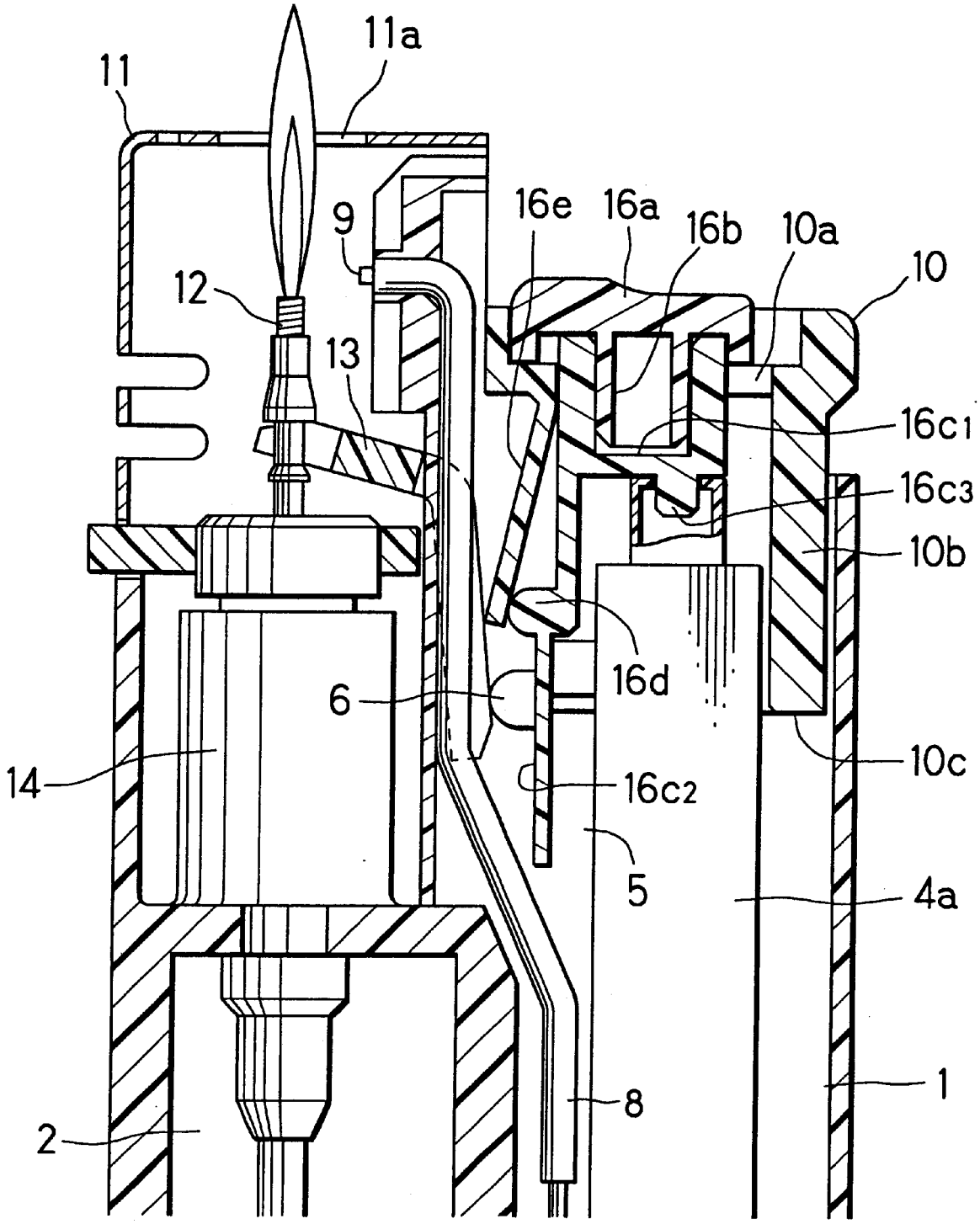
FIG. 11 is a similar enlarged longitudinal section, illustrating the locking mechanism in its ignition position.

Referring to FIG. 10, the slider piece 16*a* is moved forward against the resilient force applied by the leaf spring 16*e* until the piezoelectric unit 4 is allowed to stand upright in alignment with the flame-producing unit 10 (unlocking position). Thus, depression of the flame-producing unit is permitted for ignition (see FIG. 11).

After ignition, the thumb is removed from the slider piece 16*a*, so that the leaf spring 16*e* may allow the lock spacer 16*d* to return to its original position, in which the piezoelectric unit 4 is so inclined that the top end of the inner casing 4*b* is applied obliquely to the movable bottom end 10*c* of the flame-producing unit 10 (locking position as shown in FIG. 9).

Figure 12:
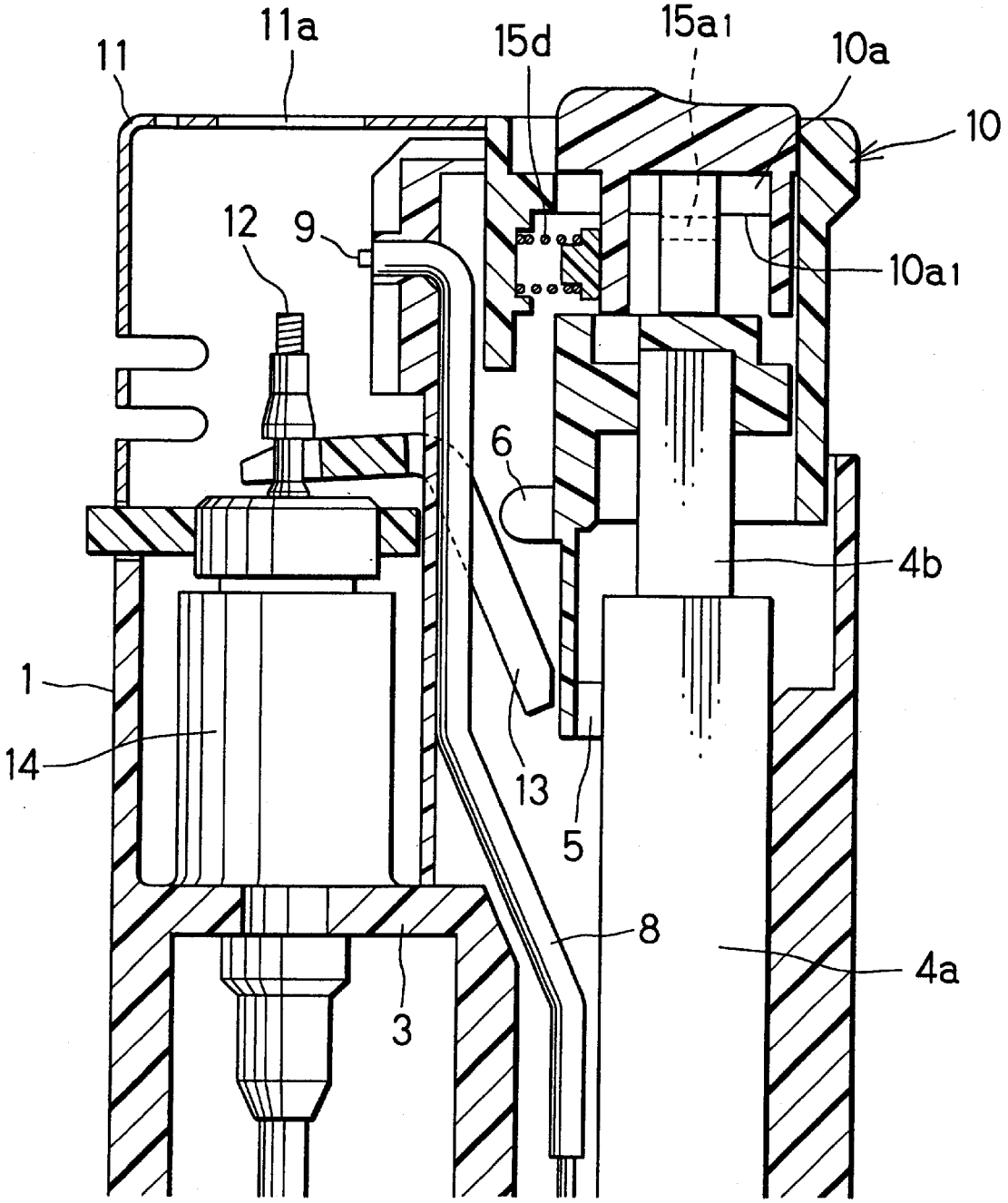
FIG. 12 is a longitudinal section of a piezoelectric lighter according to a third embodiment of the present invention.

The locking mechanisms described above may be modified within the technical scope of the present invention, as for instance, follows: the locking mechanism according to the first embodiment may be modified as shown in FIG. 12. Specifically in the locking mechanism according to the first embodiment the slider piece 15*a* has a coiled spring 15*d* contained in its cavity, and the slider piece 15*a* is spring-biased to be put apart from the wind shield 15*a*. This arrangement may be modified by positioning a coiled spring 15*d* on the front side of the lock spacer 15*b* of the slider piece 15*a*, thereby pushing the slider piece 15*a* backward. The coiled spring 15*d* may be replaced by a leaf spring or clip spring.

The locking mechanism according to the present invention is described as being applied to a piezoelectric lighter, but it may be equally applied to other lighters such as a flint lighter or an oil lighter.

As may be understood from the above, the locking mechanism assures that there can be caused no accident while a child is playing with the piezoelectric lighter. The locking mechanism has every part installed in the lighter body except for the slider piece, which, however, is hardly noticeable in appearance. The lighter, therefore, can be designed to be neat in appearance. The slider piece is coplanar with the top surface of the lighter body, so that it cannot be caught inadvertently by fingers. When the flame is extinguished by removing the thumb from the slider piece, the slider piece will be allowed to return to its initial position automatically, and therefore, the lighter cannot remain in unlocking position.

What is claimed is:

1. A locking mechanism for a lighter comprising, in its body, a flame-producing unit which can be depressed by thumb, the flame-producing unit having an inner wall defining a through hole with an inner projection formed on the inner wall and extending into the through hole, a piezoelectric unit responsive to depression of the flame-producing unit for generating a high-voltage between an associated electrode and a nozzle of a fuel valve, a valve lever responsive to depression of the flame-producing unit for opening the fuel valve, and lock means for preventing the flame-producing unit from being operated, wherein said lock means comprises a slider piece slidably attached to the top of said flame-producing unit, said slider piece having a lock spacer integrally connected to its lower surface, and a latch member responsive to said slider piece put in one position for preventing the opening of said fuel valve and/or the striking of the piezoelectric unit, and responsive to said slider piece put in the other position for permitting the opening of said fuel valve and/or the striking of the piezoelectric unit by urging the slider piece forwardly to engage the inner projection and then downwardly.

2. A locking mechanism for a lighter comprising, in its body, a flame-producing unit which can be depressed by thumb, a piezoelectric unit responsive to depression of the flame-producing unit for generating a high-voltage between an associated electrode and a nozzle of a fuel valve, a valve lever responsive to depression of the flame-producing unit for opening the fuel valve, and lock means for preventing the flame-producing unit from being operated, wherein said lock means comprises a slider piece slidably attached to the top of said flame-producing unit, said slider piece having a lock spacer integrally connected to is lower surface, and a latch member responsive to said slider piece put in one position for preventing the opening of said fuel valve and/or the striking of the piezoelectric unit, and responsive to said slider piece put in the other position for permitting the opening of said fuel valve and/or the striking of the piezoelectric unit, wherein said latch member comprises a support-and-guide for supporting the slider piece above the top of the piezoelectric unit, and an abutment spaced apart from but integrally connected to the support-and-guide for abutting on the bottom of said lock spacer only when said slider piece is put in one position, said abutment being spaced apart from the support-and-guide to define a slot wide and deep enough to allow said lock spacer to fall down in the slot.

3. A locking mechanism for a lighter according to claim 2, wherein said slot is deep enough to make useless the push stroke required for striking said piezoelectric unit.

4. A locking mechanism for a lighter according to claim 3, wherein the enclosure of the body has a shelf-like projection formed on its inner wall in the vicinity of said piezoelectric unit to limit the push stroke required for striking said piezoelectric unit.

5. A locking mechanism for a lighter according to claim 2, wherein said slider piece is spring-biased upward so as to be coplanar with the top of said flame-producing unit, allowing said lock spacer to stay above the slot.

6. A locking mechanism for a lighter comprising, in its body, a flame-producing unit which can be depressed by thumb, a piezoelectric unit responsive to depression of the flame-producing unit for generating a high-voltage between an associated electrode and a nozzle of a fuel valve, a valve lever responsive to depression of the flame-producing unit for opening the fuel valve, and lock means for preventing the flame-producing unit from being operated, wherein said lock means comprises a slider piece slidably attached to the top of said flame-producing unit, said slider piece having a lock spacer integrally connected to is lower surface, and a latch member responsive to said slider piece put in one position for preventing the opening of said fuel valve and/or the striking of the piezoelectric unit, and responsive to said slider piece put in the other position for permitting the opening of said fuel valve and/or the striking of the piezoelectric unit, wherein said latch member comprises a support-and-guide for holding and supporting the slider piece above the top of the piezoelectric unit, and a guide extension descending downward from the inner side of the support-and-guide, the descendent guide extension being urged by an associated resilient member, thereby putting the slider piece in the one position, and at the same time, pushing and inclining the piezoelectric unit to allow its outer casing to be caught by the descending bottom end of the flame-producing unit.

7. A locking mechanism for a lighter according to claim 6, wherein said resilient member is a leaf spring formed on the skirt of said flame-producing unit by cutting parallel slots therein.

* * * * *